United States Patent [19]

Mizutani et al.

[11] Patent Number: 4,849,014

[45] Date of Patent: Jul. 18, 1989

[54] MOLTEN METAL HEATING METHOD

[75] Inventors: Yoichi Mizutani, Tokai; Yoshihiro Niimi, Toyota; Ikuo Harada, Aichi, all of Japan

[73] Assignee: Aichi Steel Works, Ltd., Tokai, Japan

[21] Appl. No.: 208,055

[22] Filed: Jun. 17, 1988

[30] Foreign Application Priority Data

Jun. 24, 1987 [JP] Japan ..... 62-157173

[51] Int. Cl.[4] ..... C22B 4/00

[52] U.S. Cl. ..... 75/10.65; 75/10.19

[58] Field of Search ..... 75/10.65, 10.19

[56] References Cited

U.S. PATENT DOCUMENTS 3,160,497 8/1964 Loung ..... 75/10.19

FOREIGN PATENT DOCUMENTS 61-150758 7/1986 Japan .

*Primary Examiner*—Peter D. Rosenberg

*Attorney, Agent, or Firm*—Oblon, Fisher, Spivak, McClelland & Maier

[57] ABSTRACT

A molten metal heating method according to this invention employs a heater comprising: at least one heat evolving substance disposed in contact with a molten metal held in a container with one surface thereof; and an electrode disposed in contact with the other surface of the heat evolving substance but not in contact with the molten metal. With this arrangement, a voltage is applied between the electrode and the molten metal to flow an electric current in the heat evolving substance in thicknesswise thereof and causes the heat evolving substance to evolve heat to heat the heater at a high temperature. Thus, the heater heats the molten metal, and controls the temperature of the molten metal. As a whole, this invention improves the quality of metal products. In particular, the heater is less likely to be broken by the heat confinement in it, and can be made of a wide variety of materials.

16 Claims, 3 Drawing Sheets

MOLTEN METAL HEATING METHOD

BACKGROUND OF THE INVENTION

1. Field of the Invention

This invention relates to a molten metal heating method for heating a high temperature molten metal like molten steel held in a container. The molten metal heating method according to this invention is applicable to heating and temperature control for a molten metal held in a tundish of a continuous casting.

2. Discussion of the Prior Art

In a foundry, a molten melting is held and reserved in a container until it is processed in the next process. And there is a problem that the molten metal cools down in the container. In a continuous casting, for instance, the molten metal is held in a tundish before pouring it in a water-cooled mold, and the molten metal cannot help being cooled down in the tundish.

Accordingly, electrodes are immersed into the molten metal in the container to maintain the molten metal at a predetermined temperature, whereby an electric current is flowed in the molten metal and Joule heat is evolved to heat the molten metal directly. Further, the following heating method has been known, i.e. the molten metal in the container is heated by an induction heater, or by a plasma heater in which a plasma torch is disposed over the container.

However, the heating method using the electrodes, in which the molten metal is heated by the Joule heat evolved by the electric current flowing in the molten metal, requires a very large electric current, because the molten metal has a very small electrical resistivity. In addition, it is necessary to provide special equipment like the induction heater or the plasma heater when employing the induction heating method or the plasma heating method.

SUMMARY OF THE INVENTION

This invention is developed in view of avoiding the above drawbacks. It is therefore an object of this invention to provide a molten metal heating method using a heater having a heat evolving substance, whereby the heater is heated by heat evolved by the heat evolving substance and the molten metal is heated by the heater heated at a high temperature.

A molten metal heating method according to this invention employs at least one heater comprising a heat evolving substance disposed in contact with a molten metal held in a container with one surface thereof, and an electrode disposed in contact with the other surface of the heat evolving substance but not in contact with the molten metal. When a voltage is applied between the electrode and the molten metal, an electric current flows in the heat evolving substance in thicknesswise thereof, and causes the heat evolving substance to evolve heat for heating the heater at a high temperature. Thus, the heater heats the molten metal.

One heater or a plurality of heaters may be employed at one's discretion in the molten metal heating method according to this invention: The number of heaters employed may be one, two or more. And the valves of the voltage applied and the electric current may be determined appropriately depending on a specific heat of a molten metal, a molten metal temperature to be controlled, a volume of a molten metal held in a container. For instance, it is preferable to employ three heaters, apply a voltage of from 100 V to 1 KV and flow an electric current of from 100 A to 3 KA when heating molten steel.

When the molten metal flows in the container, it is preferable to dispose the heater and arrange the flow of the molten metal so that the heat evolving substance of the heater and the molten metal come in contact with each other. If such is the case, it is preferred to dispose the heat evolving substance perpendicular to the flow of the molten metal to transfer the heat evolved by the heat evolving substance effectively.

The heat evolving substance may be made of a non-metal heat evolving material or metal heat evolving material. As for the non-metal heat evolving material, it may mainly contain a conductive ceramic: zirconia ($ZrO_2$), mixtures of zirconia and magnesia (MgO), silicon carbide (SiC), lanthanum chromate ($LaCrO_3$), molybdenum disilicide ($MoSi_2$), titanium nitride (TiN) and titanium carbide (TiC). But it is necessary to select a material for the heat evolving substance while taking the following into consideration: a molten metal heating temperature, impact resistance of a heat evolving material at a high temperature, and whether the heater is placed in an oxidizing atmosphere or a reducing atmosphere.

When the heat evolving sustance has zirconia as a major component, it is preferred to add a stabilizer by a percentage of several to tens to prepare a stabilized zirconia or a quasistabilized zirconia avoiding the transition. As the stabilizer, the following are available: calcium oxide (CaO), magnesia (MgO), yttrium oxide ($Y_2O_3$), ytterbium oxide ($Yb_2O_3$) and scandium oxide ($Sc_2O_3$). Thus, the expansion of the heat evolving substance resulting from the transition can be avoided, and the distortion thereof can be suppressed.

Regarding the resistance of the heat evolving substance, it is preferred that the resistance shows no change or a positive characteristic when the temperature increases. The positive characteristic means that the resistance of the heat evolving substance increases as the temperature increases. When a portion of a heat evolving substance showing a positive resistance characteristic is heated at a high temperature, the resistance at the portion increases and the electric current flows in the other portions heated in a lesser degree. Consequently, the characteristic is appropriate for causing the heat evolving substance to evolve heat evenly off its surface. On the other hand, when a heat evolving substance has a negative resistance characteristic, i.e. the resistance of the heat evolving substance decreases as the temperature increases, a portion thereof heated at a high temperature shows a decreased resistance. Accordingly, the electric current flows well in the portion, but in a lesser degree in the other portions heated less. As a result, the temperature of the portion increases further and uneven heat evolution occurs in the heat evolving substance. Therefore, a heat evolving substance having a negative resistance characteristic is not preferable. If such a heat evolving substance is employed, it is necessary to stir the molten metal with the heat evolving substance to improve the heat transfer from the heat evolving substance to the molten metal.

The overall resistance R (Ω) of a heat evolving substance is in proportion to the specific resistance $\rho$ (Ωcm) and the thickness t (cm) of the heat evolving substance, and in inverse proportion to the area of the heat evolving substance, i.e. $R = \rho t/S$. It is apparent that the resistance of a heat evolving substance depends on its shape, thickness and the like, however, a the specific resistance $\rho$ of a heat evolving substance to be employed may be from $1\times10^2$ to $5\times10^3$ Ωcm at 1500° C. The specific resistance of a heat evolving substance may be varied by adding a non-conductive ceramic to a conductive ceramic and changing the mixing ratio thereof when the heat evolving substance is made of ceramics.

When the heat evolving substance is made of a conductive ceramic, it is formed by molding the powder of the conductive ceramic to a desired shape and followed by calcining the molded powder at a predetermined temperature. For instance, the conductive ceramic is completely pulverized by a ball mill or a vibration mill, and additives are added as required to prepare a raw powder. And the raw powder is molded under a pressure to form a compressed substance. After the molding, the compressed substance is dried if necessary, and heated at a high temperature to calcine. The molding under a pressure is made by a well known method like a pressing, a static hydraulic pressure pressing and a hot pressing. And it is preferable to do the calcination under non-oxidizing atmosphere, inert atmosphere or a high vacuum condition.

As for the electrode, it is necessary to make it of a material having a higher melting point than that of a molten metal lest it should be melted by the heat of the molten metal. Accordingly, it is preferred to make the electrode of carbon. Or the electrode may be made of a conductive ceramic having a small electrical resistance. If such is the case, it is possible to mold and calcine the electrode and the heat evolving substance integrally.

In addition, when heating a molten metal by the heat evolved by the heat evolving substance according to this invention, bubbling the molten metal by feeding a gas like argon into the molten metal or by a mechanical stirring is also effective to keep the molten metal temperature uniform. Further, the following arrangement is also effective to control the molten metal temperature more precisely: a sensor like a $\gamma$-ray meter for detecting the amount of the molten metal held in the container and a controller for controlling the electric current supplied to the heat evolving substance in accordance with detection signals output by the sensor. With this arrangement, the electric current supplied to the heat evolving substance is controlled in accordance with the variation in the molten metal amount held in the container.

In the molten metal heating method according to this invention, when a voltage is applied between the electrode and the molten metal, an electric current flows in the heat evolving substance in thicknesswise thereof to cause the heat evolving substance to evolve heat. The heat evolved off the heat evolving substance is transferred to the molten metal to heat the molten metal. Thus, the heat evolved off the heat evolving substance is transferred to the molten metal efficiently, since the heat evolving substance provides an appropriate heat radiating area.

The molten metal heating method according to this invention thus controls the temperature of molten metal held in the container by causing the heat evolving substance to evolve heat. And it is therefore apparent that the molten metal heating method according to this invention improves the quality of metal products manufactured by the continuous casting, since the molten metal can be supplied at an appropriate temperature to the water-cooled mold disposed below the tundish.

Further, the molten metal heating method according to this invention employs the heat evolving substance having a greater length and width than its thickness. As the electric current flows in the thicknesswise, the heat evolving substance provides a larger heat radiating area. Accordingly, it is possible to suppress the heat confinement within the heat evolving substance and the breakage thereof due to the heat confinement as less as possible.

Furthermore, the heat evolving substance can be made of a wide variety of materials from one having a higher heat resistance temperature to one having a lower heat resistance temperature, since the heat confinement within the heat evolving substance is suppressed as above-mentioned and since the internal temperature of the heat evolving substance can be kept lower by the same degree.

BRIEF DESCRIPTION OF THE DRAWINGS

The above and other objects, features and advantages of this invention will become fully apparent from the following description taken in conjunction with the accompanying drawings, in which.

DETAILED DESCRIPTION OF THE PREFERRED EMBODIMENTS

The present invention will be hereinafter described with reference to preferred embodiments. The preferred embodiments were applied to a continuous casting process.

First Preferred Embodiment

Figure 1:
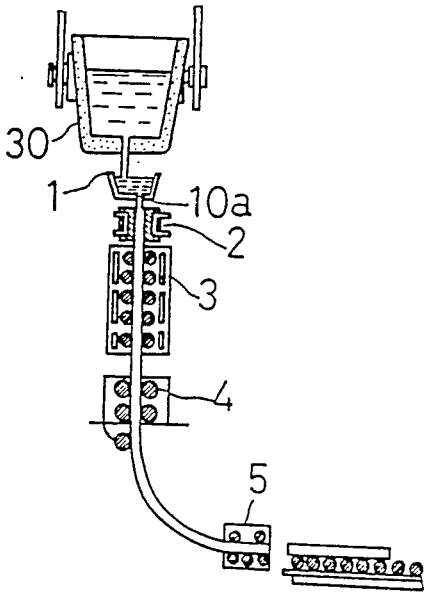
FIG. 1 is a schematic illustration of a continuous casting process.

First a continuous casting system to which preferred embodiments were applied will be hereinafter described with reference to FIG. 1. The system comprises a tundish 1, i.e. a container for holding molten steel, a water-cooled mold 2 disposed below the tundish 1, a secondary water spray chamber 3, pinch rolls 4, and flattening rolls 5. The tundish 1 holds about 5 tons of the molten steel.

Figure 2:
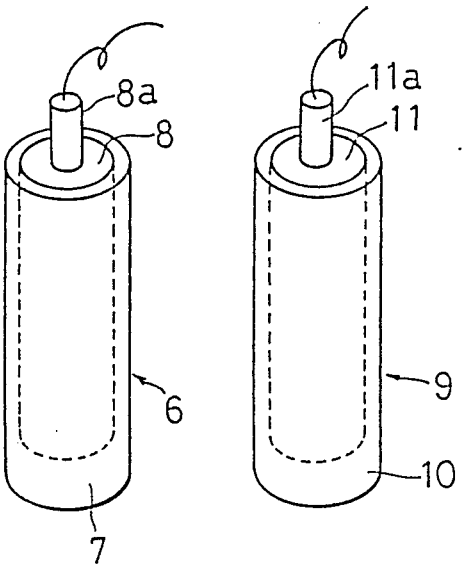
FIG. 2 is a perspective view of heaters according to a first preferred embodiment of this invention.
Figure 3:
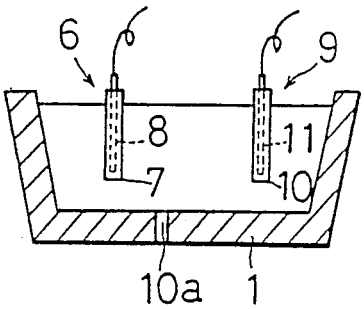
FIG. 3 is a schematic sectional illustration of the heaters according to the first preferred embodiment in operation.

Next a first heater 6 and a second heater 9 employed in this preferred embodiment will be hereinafter described with reference to FIGS. 2 and 3. The first heater 6 comprises a cylindrical heat evolving substance 7 and an electrode 8 made of carbon loaded in a center bore of the heat evolving substance 7. The heat evolving substance 7 is made mainly of zirconia and magnesia, and the electrode 8 has a protruding terminal 8*a*. The second heater 9 has basically the same arrangement as that of the first heater 6, and comprises a cylindrical heat evolving substance 10 and an electrode 11 made of carbon loaded in a center bore of the heat evolving substance 10. The heat evolving substance 10 is made mainly of zirconia and magnesia, and the electrode 11 has a protruding terminal 11*a*.

The operation of the heaters 6 and 9 will be hereinafter described. The heat evolving substances 7 and 10 were preheated to approximately 1300° C. with a burner and the like. This preheating was done to secure the conductivity of heat evolving substances 7 and 10. After preheating the heat evolving substances 7 and 10, the heaters 6 and 9 were immersed into the molten steel transferred from a ladle 30 and held in the tundish 1. The temperature of the molten steel was from 1400° C. to 1600° C. approximately. The heaters 6 and 9 immersed into the molten steel is illustrated in FIG. 3.

If the heat evolving substances 7 and 10 break, the electrodes 8 and 11 communicate with the molten steel directly and the heat generation off the heat evolving substances 7 and 10 becomes extremely small. As a result, it is not possible to use the heaters 6 and 9. Here, the preheating described above can prevent the rapid heating of the heat evolving substances 7 and 10, and suppresses the breakage of heat evolving substances 7 and 10 as less as possible.

After immersing the heaters 6 and 9 into rhe molten steel, the terminals 8*a* and 11*a* were connected to an alternating current power source to apply a voltage between the terminals 8*a* and 11*a*. Thus, an electric current flowed in a circuit comprising the heat evolving substance 7 of the heater 6, the heat evolving substance 10 of the heater 9, and the molten steel held and interposing between the heat evolving substances 7 and 10 in the tundish 1. The voltage applied was about 100 to 600 V, and the electric current flowed was about 200 to 400 A. Consequeently, the heat evolving substances 7 and 10 evolved a high temperature heat, and the molten steel held in the tundish 1 was heated by the heat, and the temperature was increased by about 1° to 30° C. to keep the molten steel at an appropriate temperature.

It is apparent from the above description that the molten metal heating method according to this preferred embodiment requires less electric current and is easy to control electrically compared with the conventional method in which a molten metal is heated by Joule heat generated in the molten metal itself by a large electric current flowed in the molten metal. This is because the molten metal is heated by the heat generated off the heat evolving substances 7 and 10 of the heaters 6 and 9.

Further, the heat evolving substances 7 and 10 according to this preferred embodiment have a larger surface area, namely they offer a larger heat radiating area since they have a cylindrical shape. Accordingly, it is possible to suppress the heat confinement within the heat evolving substances 7 and 10 and the breakage thereof due to the heat confinement as less as possible. Therefore, the heat evolving substances 7 and 10 can be made of a material having a lower heat resistance temperture in this preferred embodiment. In other words, the conductive ceramic for making the heat evolving substances 7 and 10 can be selected from a wide variety of conductive ceramics, i.e. from a conductive ceramic having a higher heat resistance temperature to a conductive ceramic having a lower heat resistance temperature.

After the temperature control in the tundish 1 as described above, the molten steel was delivered out of a delivery opening 10*a*. It is then cooled and solidified to a slab in the water-cooled mold 2, and further cooled by splashing cooling water in the secondary water spray chamber 3. The slab cooled and solidified was withdrawn downward by the pitch rollers 4, and cut to a desired length.

Second Preferred Embodiment

Figure 4:
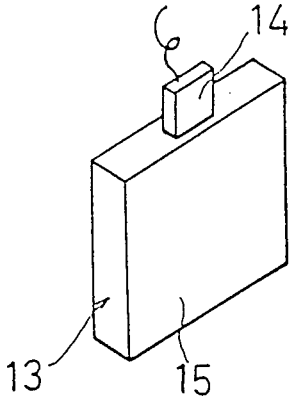
FIG. 4 is a perspective view of a heater according to a second preferred embodiment of this invention.

As shown in FIG. 4, a heater 13 according to a second preferred embodiment is the one formed into a plate. It comprises a plate-shaped electrode 14 and a heat evolving substance 15 covering the plate-shaped electrode 14. The heat evolving substance 15 was made mainly of magnesia.

Third Preferred Embodiment

Figure 5:
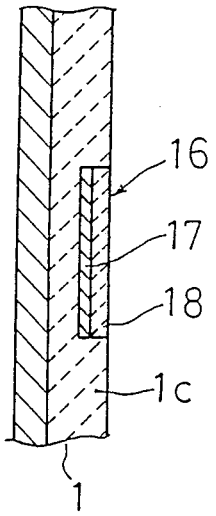
FIG. 5 is a cross sectional view of a heater according to a third preferred embodiment of this invention.

A third preferred embodiment according to this invention is shown in FIG. 5. A heater 16 according to this preferred embodiment is buried in an inner lining 1*c* made of alumina and magnesia and forming the inner wall of the tundish 1. The heater comprises a plate-shaped electrode 17 made mainly of carbon, and a heat evolving substance 18 made mainly of magnesia and covering one surface of the electrode 17. The heat evolving substance 18 is exposed to the inner side of the tundish 1, and is brought into contact with a molten metal held in the tundish 1. And the other side of the electrode 17 is covered and insulated with the inner lining 1*c* of the tundish 1.

Fourth Preferred Embodiment

A fourth preferred embodiment according to this invention will be hereinafter described with reference to FIGS. 6 through 9. This preferred embodiment is also an application of this invention to the continuous casting process.

In this preferred embodiment, a first heater 20 has a plate shape. It comprises a plate-shaped electrode 21 made of carbon, and a heat evolving substance 22 made mainly of magnesia and covering the plate-shaped electrode 21. The plate-shaped electrode 21 comprises insulators 210 and 211 made of alumina, and electrode components 212, 213 and 214. The plate-shaped electrode 21 is thus divided into three electrode components 212, 213 and 214 by the insulators 210 and 211. The electrode components 212, 213 and 214 have protruding terminals 212*a*, 213*a* and 214*a* respectively. And a second heater 24 has basically the same arrangement as that of the first heater 20, and comprises a plate-shaped electrode 25 made of carbon, and a heat evolving substance 26 made mainly of magnesia and covering the plate-shaped electrode 25. The plate-shaped electrode 25 comprises insulators 250 and 251 made of alumina, and electrode components 252, 253 and 254. The plate-shaped electrode 25 is thus divided into three electrode components 252, 253 and 254 by the insulators 250 and 251. The electrode components 252, 253 and 254 have protruding terminals 252*a*, 253*a* and 254*a* respectively. And the surfaces of the electrodes 21 and 25, which are not in contact with the heat evolving substances 22 and 26, are covered with insulating films made of an electric insulating material.

Figure 6:
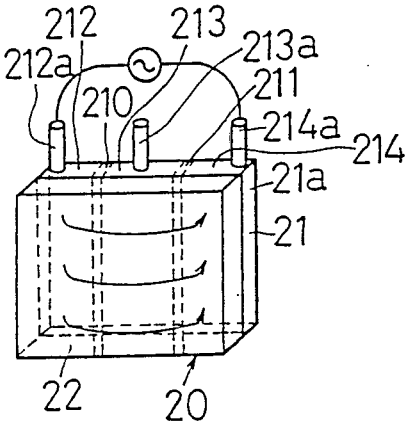
FIG. 6 is a perspective view of a heater according to a fourth preferred embodiment of this invention.

The operation of the heaters 20 and 24 will be hereinafter described. First, the first heater 20 was preheated by the following operation: The terminals 212*a* and 214*a* were connected to an alternating current power source to apply a voltage of from 100 to 600 V between the electrode components 212 and 214 as illustrated in FIG. 6, and an electric current of from 100 A to 1 KA flowed form the electrode component 212 to the electrode component 214 through the heat evolving substance 22 to cause the heat evolving substance 22 to evolve heat. In this way, the heat evolving substance 22 was preheated at approximately 1300° C. Then, the heater 24 was preheated by the same operation: The terminals 252*a* and 254*a* were connected to an altenating current power source to apply a voltage of from 100 to 600 V between the electrode components 252 and 254, and an electric current of from 100 A to 1 KA flowed from the electrode component 252 to the electrode component 254 through the heat evolving substance 26 to cause the heat evolving substance 26 to evolve heat. In this way, the heat evolving substance 26 was preheated at approximately 1300° C. Preheating the heaters 20 and 24 before immersing them into a molten metal is effective to suppress the rapid heating of the heat evolving substances 22 and 26 and the breakage thereof as less as possible.

Figure 7:
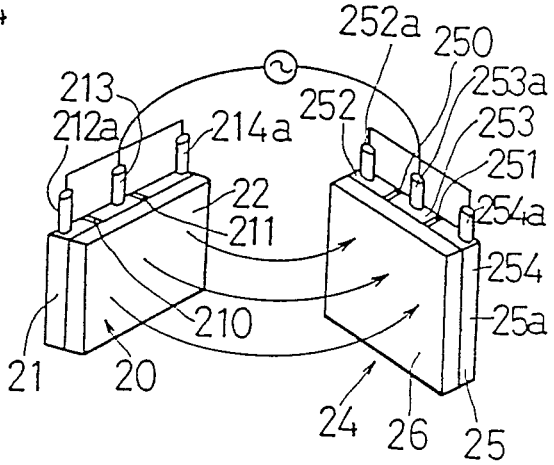
FIG. 7 is a perspective view of the heaters according to the fourth preferred embodiment of this invention under a voltage application.

After immersing the heaters 20 and 24 into a molten metal as described for the first preferred embodiment, the terminals 212*a*, 213*a* and 214*a* of the heater 20 were connected to an alternating current power source and the terminals 252*a*, 253*a* and 254*a* of the heater 24 were connected to the alternating current power source as illustrated in FIG. 7. Consequently, an electric current flowed from the heater 22 to the heater 24 through the molten metal, and caused the heat evolving substances 22 and 26 to evolve heat. Thus, the molten metal was heated.

Figure 8:
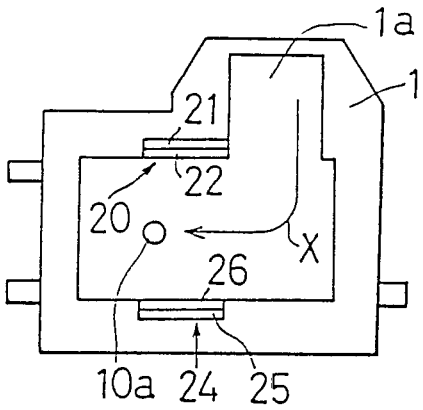
FIG. 8 is a plan view in which the heaters according to the fourth preferred embodiment of this invention are immersed into a molten metal.
Figure 9:
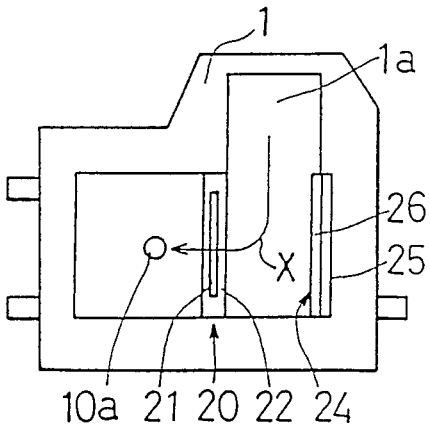
FIG. 9 is another plan view in which the heaters according to the fourth preferred embodiment of this invention are immersed into a molten metal in another disposition.

In this preferred embodiment, the molten metal was poured from the ladle 30 through an inlet opening 1*a* of the tundish 1, and flowed toward the delivery opening 10*a* formed in the bottom of the tundish 1 in the direction of an arrow "X" shown in FIG. 8. Accordingly, the heaters 20 and 24 were disposed and immersed in the molten metal in parallel with the molten metal flow. In addition, the heater 20 may be disposed and immersed in the molten metal in perpendicular to the molten metal flow and the heater 24 may be buried in the inner wall of the tundish 1. In this case, the molten metal poured through the inlet opening 1*a* flows between the space formed by the heater 20 and the bottom of the tundish 1.

Fifth Preferred Embodiment

Figure 10:
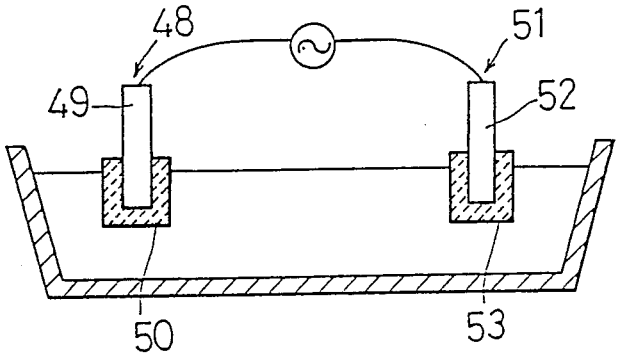
FIG. 10 is a schematic sectional illustration of heaters according to a fifth preferred embodiment of this invention in operation.

A fifth preferred embodiment according to this invention is shown in FIG. 10. This preferred embodiment is also an application of this invention to a tundish employed in the continuous casting process.

A heater 48 of this preferred embodiment comprises a rod-shaped electrode 49 made of carbon and a cap-shaped heat evolving substance 50 made mainly of magnesia and detachably enclosing the electrode 49. The heat evolving substance 50 is formed into a cap-shape. Another heater 51 has basically the same arrangement as that of the heater 48, and comprises a rod-shaped electrode 52 made of carbon and a cap-shaped heat evolving substances 53 made mainly of magnesia and detachably enclosing the electrode 52. The heat evolving substances 50 and 53 have a female thread formed on their inner walls, and engage with the electrode 49 and 52 having a male thread formed at their ends. Also in this preferred embodiment, insulating films made of alumina and magnesia cover the surfaces of the electrodes 49 and 52 which are not in contact with the heat evolving substances 50 and 53.

What is claimed is:

1. A molten metal heating method comprising:

providing a heater having a heat evolving layer and an electrode contacting one surface of said heat evolving layer;

disposing said heater into molten metal so that a surface of said heat evolving layer opposite said one surface of said heat evolving layer in contact with said electrode is in contact with said molten metal, whereby said electrode is separated from, and not in contact with, said molten metal by said heat evolving layer; and applying a voltage between said electrode and said molten metal to pass an electric current through said heat evolving layer thereby to generate heat within said heat evolving layer, wherein the heat generated within said heat evolving layer heats said molten metal.

2. A molten metal heating method according to claim 1, wherein surfaces of said electrode not in contact with said heat evolving substances are covered with an insulating material.

3. A molten metal heating method according to claim 1, wherein said heater has a cylindrical shape.

4. A molten metal heating method according to claim 1, wherein said heater has a plate shape.

5. A molten metal heating method according to claim 4, wherein said heater comprises a plate-shaped electrode comprising three electrode components divided by two insulators, and a plate-shaped heat evolving substances covering said plate-shaped electrode.

6. A molten metal heating method according to claim 5, wherein surfaces of said electrode components not covered with said plate-shaped heat evolving substances are covered with an insulating material.

7. A molten metal heating method according to claim 1, wherein said heater comprises a rod-shaped electrode, and a cap-shaped heat evolving substance detachably enclosing said electrode at one end thereof.

8. A molten metal heating method according to claim 1, wherein a plurality of said heaters are employed.

9. A molten metal heating method according to claim 8, wherein two of said heaters are employed.

10. A molten metal heating method according to claim 9, wherein at least one of said heaters are buried in said container.

11. A molten metal heating method according to claim 1, wherein said heater is disposed in a perpendicular manner with respect to the flow of said molten metal.

12. A molten metal heating method according to claim 1, wherein said heat evolving substance is made mainly of conductive ceramics.

13. A molten metal heating method according to claim 12, wherein said heat evolving substance is made mainly of a material selected from the group consisting of zirconia, magnesia and a mixture thereof.

14. A molten metal heating method according to claim 1, wherein said heat evolving substance has a specific resistance ($\rho$) falling in the range of from $1\times10^2$ to $5\times10^3$ $\Omega$ cm at 1500° C.

15. A molten metal heating method according to claim 1, wherein said container is a tundish for temporarily holding said molten metal poured from above having a discharge opening for discharging said molten metal.

16. A molten metal heating method according to claim 1, wherein said step of providing a heater comprises:

selecting the specific resistance of said heat evolving layer as higher than that of said electrode and said molten metal.

* * * * *